US007077555B2

(12) United States Patent
Hoffbauer

(10) Patent No.: US 7,077,555 B2
(45) Date of Patent: Jul. 18, 2006

(54) CHANDELIER CRYSTAL WITH LED

(75) Inventor: Bernd Hoffbauer, Herne (DE)

(73) Assignee: Herner Glas Bernd Hoffbauer GmbH & Co. Leuchten und Industrieglas KG, Herne (DE)

( * ) Notice: Subject to any disclaimer, the term of this patent is extended or adjusted under 35 U.S.C. 154(b) by 126 days.

(21) Appl. No.: 10/773,117

(22) Filed: Feb. 5, 2004

(65) Prior Publication Data

US 2004/0184285 A1 Sep. 23, 2004

(30) Foreign Application Priority Data

Feb. 17, 2003 (DE) ..... 103 06 753

(51) Int. Cl.
*F21V 7/04* (2006.01)

(52) U.S. Cl. ..... 362/605; 362/104

(58) Field of Classification Search ..... 362/23, 362/26, 571, 605, 103, 104, 326
See application file for complete search history.

(56) References Cited

U.S. PATENT DOCUMENTS 4,573,766 A * 3/1986 Bournay et al. ..... 349/65
6,402,339 B1 * 6/2002 Mukogawa et al. ..... 362/184

FOREIGN PATENT DOCUMENTS

| | | |
|---|---|---|
| DE | 199 00 525 | 7/2000 |
| DE | 201 12 051 | 3/2002 |
| DE | 202 01 223 | 6/2002 |
| DE | 101 01 893 | 7/2002 |
| FR | 2 807 281 | 10/2001 |

* cited by examiner

*Primary Examiner*—John Anthony Ward
(74) *Attorney, Agent, or Firm*—Andrew Wilford

(57) ABSTRACT

A lamp crystal has a transparent body formed with an outwardly open bore and having an outer surface having a region with a matte finish, and a light-emitting diode fixed in the bore. The outer surface is substantially smooth and polished except at the region with the matte finish. The matte-finish region extends peripherally around the body.

7 Claims, 1 Drawing Sheet

FIG. 1
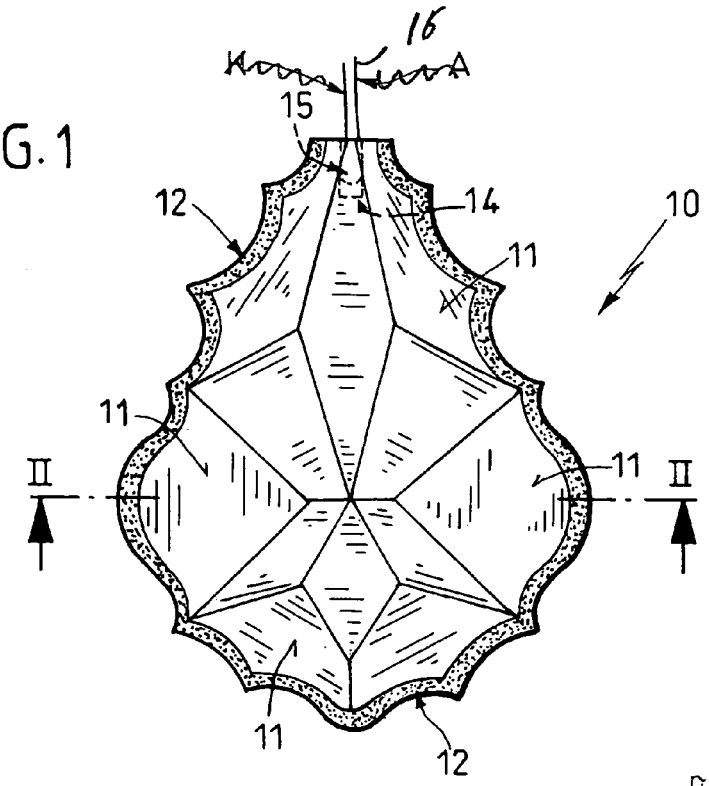
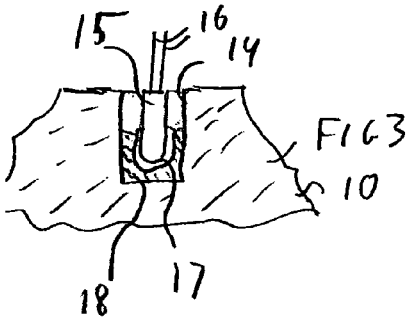
FIG. 3
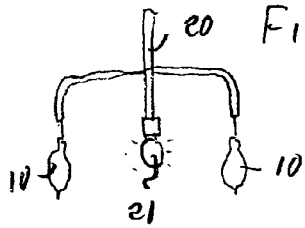
FIG. 4
FIG. 2
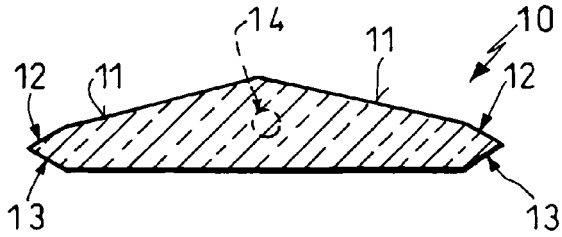

CHANDELIER CRYSTAL WITH LED

FIELD OF THE INVENTION

The present invention relates to a so-called lamp crystal or jewel. More particularly this invention concerns a lamp crystal that is electrically lit.

BACKGROUND OF THE INVENTION

A typical chandelier crystal is a faceted body of glass or clear plastic, e.g. acrylic. A plurality of such crystals are hung in an array around a light source, typically an incandescent electrical lamp, so that light from the lamp passes through and is reflected by facets of the crystals and in part refracted to spectra by the shapes of the crystals. The effect is of a dazzling, multipoint light source and is very attractive.

German utility model 201 12 051 of F. Wild describes uses a faceted jewel-like shade holding a standard incandescent bulb. This fixture emits a pleasant light, but is not readily adaptable to a chandelier.

German patent 199 00 525 of O. Obermaier describes a lamp having a shade, a central incandescent lamp, and a plurality of crystals hung between the shade and the lamp. Such a system provides a nice effect, but is little more than a combination of known devices.

In German patent 101 01 893 of B. Hoffbauer a log-voltage halogen lamp is imbedded by means of a complex heat-resistance socket in a glass ball. The extreme heat generated by the lamp considerably elevates the cost of the unit and the resultant effect so very bright that it is difficult to employ artistically.

Light-emitting diodes (LED's) are used in a Christmas-tree light set described in German utility model 202 01 223 of K. Wang. The individual LED's are fitted to respective transparent blocks. Such a simple unit is not usable in a chandelier.

LED's are also used in the system described in French patent publication 2,807,281 of C. Mermaz. This is a throw-away unit that can be built into a flashlight, a drinking cup, a pool light, a pathway marker, or the like. Once again it is a simple system like that of German '223 described above.

OBJECTS OF THE INVENTION

It is an object of the present invention to provide an improved lamp crystal.

Another object is the provision of such an improved lamp crystal which provides a more interesting light effect.

SUMMARY OF THE INVENTION

A lamp crystal has according to the invention a transparent body formed with an outwardly open bore and having an outer surface having a region with a matte finish, and a light-emitting diode fixed in the bore. The outer surface is substantially smooth and polished except at the region with the matte finish.

Thus with this lamp crystal the matte-finish region will glow, while the smooth regions will behave like a standard chandelier crystal, that is one can see through them, while at the same time they reflect and refract light. The effect is extremely interesting and beautiful.

According to the invention the matte-finish region extends peripherally around the body. Thus each crystal has, in effect, a glowing rim, an effect not achievable hitherto. More particularly the body is formed with a pair of edge bevels that constitute the matte-finish region. Thus each crystal is outlined by a ring of light. It would of course also be possible to provide a matte finish over the entire surface of the crystal to make it glow. Similarly the bore could be formed by a body of clear epoxy or the like in which the LED is imbedded and that is adhered to a face of the crystal body.

The bore holding the LED has a matte-finish internal surface. The diode can be a snug fit in the bore, held in place by a force-fit or a special clip or spring. Alternately according to the invention a mass of transparent potting is provided between the diode and the internal surface of the bore. This potting, which in effect is glue, serves not only to secure the diode in the bore, but also eliminates the light-dissipating effect of the bore's matte finish, so that light from the diode will reflect inside the body and only really appear at the matte-finish region.

The diode carries a lens and has electrical supply wires sufficiently strong to hang the crystal by. Thus the crystal will, when not energized, will have the appearance of a standard chandelier crystal.

BRIEF DESCRIPTION OF THE DRAWING

The above and other objects, features, and advantages will become more readily apparent from the following description, reference being made to the accompanying drawing in which:

FIG. 1 is a large-scale side view of a chandelier crystal according to the invention;

FIG. 2 is a section taken along line II—II of FIG. 1;

FIG. 3 is large-scale sectional view of a detail of FIG. 1; and

FIG. 4 is a small-scale schematic view of a chandelier incorporating the crystal in accordance with the invention.

SPECIFIC DESCRIPTION

As seen in FIG. 1 a lamp crystal or crystal 10 according to the invention is made of a transparent material, for example glass or acrylic, and has an outer surface formed mostly by highly polished planar facets 11. In addition as shown in FIG. 2 the crystal 10 is formed around its periphery on its front and back with annular matte-finish beveled regions 12 and 13.

An upper end of the crystal 10 is formed with a short 2.85 mm diameter blind cylindrical bore 14 in which is fitted a small LED 15 having supply leads 16 and an epoxy lens 17. Drilling of the bore 14 inherently gives its interior surface a matte finish, so the LED 15 is secured in place by a transparent UV-cured transparent potting or glue 18 that, in effect, eliminates the light-blocking effect of the bore's matte finish. Such a glue is described in above-cited German 101 01 893. The leads 16 can serve for hanging the crystal 10. The LED 15 has an output beam with a flare angle between 20° and 90°.

As shown schematically in FIG. 4, crystals 10 according to the invention are mounted on a chandelier frame 20 in an array around a central incandescent lamp 21. The lamp 21 and the LED's 15 are electrically energized. The effect is that light emitted by the lamp 21 passes as is standard through the clear crystals 10 and is refracted and reflected by them for the standard chandelier effect. In addition the light from the LED 15 of each crystal 10 is reflected inside the body of the crystal 10 and causes the matte-finish strips 12 and 13 to glow, creating an outline around each crystal 10.

I claim:

1. A lamp crystal comprising: a transparent body formed with an outwardly open bore and having an outer surface that has a region with a semitransparent matte finish an that is substantially smooth, transparent, and polished except at the matte-finish region; and a light-emitting diode fixed in the bore and having electrical supply wires sufficiently strong to hang the crystal from above.

2. The lamp crystal defined in claim 1 wherein the matte-finish region extends peripherally around the body.

3. The lamp crystal defined in claim 2 wherein the body is formed with a pair of edge bevels that constitute the matte-finish region.

4. The lamp crystal defined in claim 1 wherein the bore has a matte-finish internal surface.

5. The lamp crystal defined in claim 4 wherein the diode is a snug fit in the bore.

6. The lamp crystal defined in claim 4, further comprising a mass of transparent potting between the diode and the internal surface of the bore.

7. The lamp crystal defined in claim 1 wherein the diode carries a lens.

* * * * *